US008579551B2

(12) United States Patent
Sanders

(10) Patent No.: US 8,579,551 B2
(45) Date of Patent: Nov. 12, 2013

(54) MSE ANCHOR SYSTEM

(76) Inventor: Mark Sanders, Zionsville, IN (US)

( * ) Notice: Subject to any disclaimer, the term of this patent is extended or adjusted under 35 U.S.C. 154(b) by 342 days.

(21) Appl. No.: 13/007,771

(22) Filed: Jan. 17, 2011

(65) Prior Publication Data

US 2012/0183360 A1 Jul. 19, 2012

(51) Int. Cl.
*E02D 17/20* (2006.01)
*E02D 29/02* (2006.01)
*E02D 5/76* (2006.01)

(52) U.S. Cl.
USPC ..... 405/302.4; 405/262; 52/155

(58) Field of Classification Search
USPC ..... 52/155, 158, 156; 405/258.1, 259.1, 405/262, 284, 286, 302.4, 302.7
See application file for complete search history.

(56) References Cited

U.S. PATENT DOCUMENTS

RE13,202 E * 2/1911 Atchison ..... 52/154
1,426,044 A * 8/1922 Clum ..... 52/155
1,578,612 A * 3/1926 Scanlan ..... 52/155
1,597,573 A * 8/1926 Blue ..... 40/124.5
2,404,928 A * 7/1946 Schutten ..... 411/446
2,696,137 A * 12/1954 Thomas et al. ..... 411/74
3,286,416 A * 11/1966 Ashworth ..... 52/153
3,686,873 A 8/1972 Vidal
4,084,914 A * 4/1978 Humphrey et al. ..... 404/10
4,116,010 A 9/1978 Vidal
4,241,146 A 12/1980 Sivachenko et al.
4,523,880 A * 6/1985 Isler ..... 405/259.1
4,710,062 A * 12/1987 Vidal et al. ..... 405/262
5,372,461 A 12/1994 Nanayakkara
5,494,378 A * 2/1996 Hanson ..... 405/244
5,890,843 A 4/1999 Bastick et al.
6,461,084 B1 * 10/2002 Stuart ..... 405/244
7,025,016 B1 * 4/2006 Landes ..... 116/209
7,090,429 B1 * 8/2006 Humphrey et al. ..... 404/9
7,270,502 B2 * 9/2007 Brown ..... 405/262
7,338,233 B2 * 3/2008 Barrett et al. ..... 405/259.5

* cited by examiner

*Primary Examiner* — Tara M. Pinnock
(74) *Attorney, Agent, or Firm* — Maginot, Moore & Beck, LLP

(57) ABSTRACT

A mechanically stabilized earth (MSE) system includes a vertically oriented wall offset from an earthen feature, backfill disposed between the wall and the earthen feature, and a plurality of anchor elements attached at one end to the wall and extending from the wall toward the earthen feature. The plurality of anchor elements are embedded within the backfill and include an elongated strap having an attachment end configured for attachment to the MSE wall and opposite surfaces along the length thereof. The anchor element further includes a plurality of punched openings along the length of the strap, each opening including a punched tab projecting outward from one of the opposite surfaces.

19 Claims, 2 Drawing Sheets

MSE ANCHOR SYSTEM

BACKGROUND

The present invention relates to earth retaining walls, such as mechanically stabilized earth retaining walls, and particularly to anchor system for such walls.

Mechanically stabilized earth (MSE) retaining walls are construction devices used to reinforce earthen features, such as slopes, particularly where changes in elevations occur rapidly, such as site developments with steeply rising embankments. These embankments must be secured, such as by retaining walls, against collapse or failure to protect persons and property from possible injury or damage caused by the slippage or sliding of the earthen slope. For instance, MSE walls are frequently integrated into overpass and bridge embankment structures. MSE systems can have other applications, such as to support earthen features providing sound abatement for a neighborhood or commercial complex adjacent a heavily traveled road. MSE walls can also be used to support and retain earthen landscaping features.

MSE system designs must account for lateral earth and water pressures, the weight of the wall, temperature and shrinkage effects, and earthquake loads. As illustrated in FIG. 1, a typical MSE system 10 employs a wall 12 supported on a base material 18. The wall 12 is offset from retained earth or soil E which is typically at a 45° slope. Granular backfill 16 occupies the space between the wall and the retained soil. The MSE system 10 includes a plurality of anchor elements 14 projecting from the wall 12 into the backfill 16. Friction between the anchor elements 14 and granular backfill 16 hold the wall in place, which in turn holds the backfill and retained soil E in place.

In a typical MSE system, the wall 10 is formed of a plurality of modular facing units, such as precast concrete members, blocks, or panels, stacked together. The facing units may be configured to create an aesthetic visual appearance facing away from the reinforced soil. The anchor elements 14 may be either metallic or polymeric tensile reinforcements disposed in the backfill or soil mass behind the wall.

The anchor elements 14 may be fastened to or held within the wall 12 in a number of ways. In one approach, the anchor elements are fastened to a wall anchor that is embedded or trapped within the wall itself. Thus, as shown in FIG. 2, a wall anchor 20 includes a generally triangularly shaped embedded end 21 from which extends an elongated attachment end 22. The attachment end receives a clamping bolt and nut 23 that can be used to clamp one end of an anchor element 14 to the wall anchor 20. The embedded end 21 may be anchored within a concrete wall block as the block is being poured, or may be embedded within a cavity formed in adjacent stacked wall blocks. Another form of wall anchor 25 is shown in FIG. 3. This wall anchor includes a pair of legs 26 embedded within the wall 12. An elongated attachment end 27 extends from the wall 12 and includes a clamping bolt and nut 28 for attachment to an anchor element.

The standard specifications for MSE walls are based upon the strength of the interlocking components forming the wall and the load created by the backfill.

Once the desired wall height and type of ground conditions are known, the number of anchor elements 14 or tensile reinforcements, the vertical spacing between adjacent reinforcements, and the lateral positioning of the reinforcements may be determined, dependent upon the load capacity of the interlocking components. A typical anchor element is in the form of a planar wire grid spanning the width of the wall 12 and projecting a predetermined distance (i.e., 3 feet) from the wall into the backfill 16.

Heretofore, construction of such mechanically stabilized earth retaining walls has been limited to large, financially significant projects. This is due in part to the cost of the mechanical components used for construction of such earth retaining walls. To reduce costs, tensile reinforcements other than grids have been developed for use with mechanically stabilized earth retaining walls. For instance, flexible perforated reinforcement sheets have been used that are significantly less expensive, but more difficult to connect to the MSE wall.

As the demand for MSE systems increases, the need for cheaper, effective anchor elements or tensile reinforcements also increases.

SUMMARY

In order to address this need, the present invention contemplates an anchor element for an MSE system having a wall supporting backfill, comprising an elongated strap having an attachment end configured for attachment to the MSE wall and opposite surfaces along the length thereof. The anchor element further comprises a plurality of punched openings along the length of the strap, each opening including a punched tab projecting outward from one of the opposite surfaces.

In another aspect, an MSE system comprises a vertically oriented wall offset from an earthen feature, backfill disposed between the wall and the earthen feature, and a plurality of anchor elements attached at one end to the wall and extending from the wall toward the earthen feature. The plurality of anchor elements are embedded within the backfill and include an elongated strap having an attachment end configured for attachment to the MSE wall and opposite surfaces along the length thereof. The anchor elements further includes a plurality of punched openings along the length of the strap, each opening including a punched tab projecting outward from one of the opposite surfaces.

DESCRIPTION OF THE ILLUSTRATED EMBODIMENTS

Figure 1:
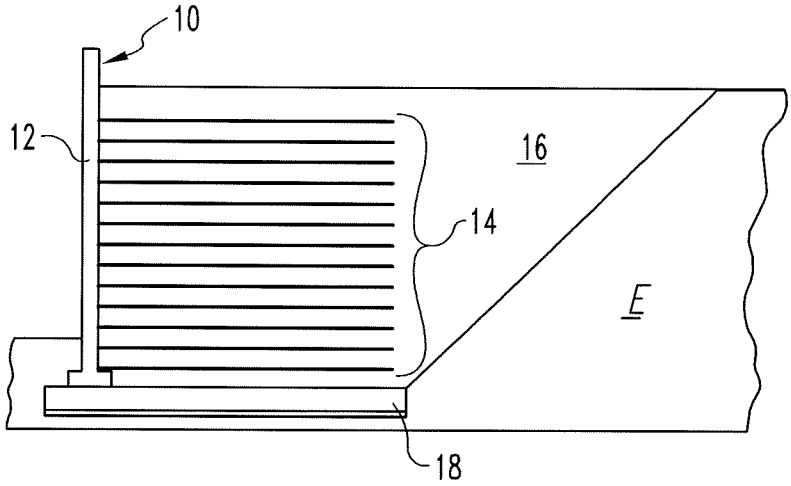
FIG. 1 is a side representation of an MSE system.
Figure 2:
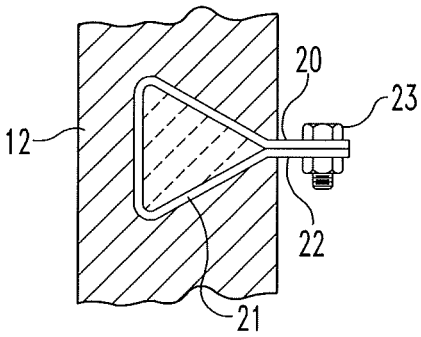
FIG. 2 is a side partial cross-sectional view of a wall anchor for an MSE system such as the system shown in FIG. 1.
Figure 3:
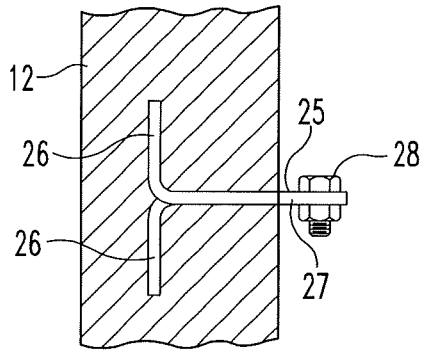
FIG. 3 is a side partial cross-sectional view of another wall anchor for an MSE system such as the system shown in FIG. 1.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 4:
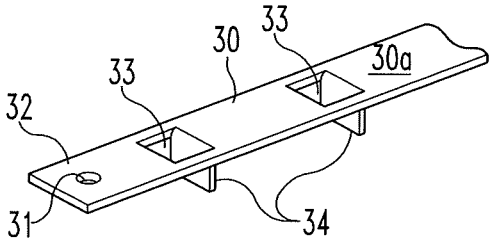
FIG. 4 is a perspective view of an anchor element for use in an MSE system as shown in FIG. 1.
Figure 5:
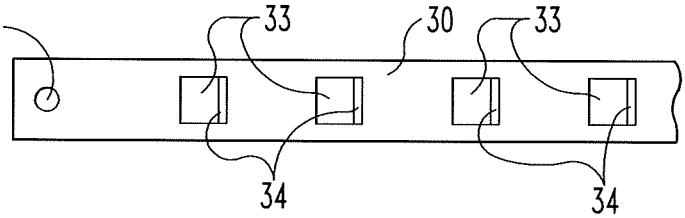
FIG. 5 is a top elevational view of the anchor element shown in FIG. 5.
Figure 6:
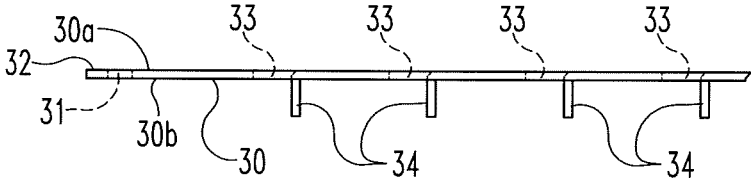
FIG. 6 is a side elevational view of the anchor element shown in FIG. 5.

An anchor strap 30 as shown in FIGS. 4-6 is provided that can be integrated into the MSE system 10 shown in FIG. 1. In particular, the plurality of anchor elements 14 shown in FIG. 1 may include the anchor strap 30. The anchor strap 30 is a generally planar strip having opposite surfaces 30*a*, 30*b* against which the backfill material bears. The anchor strap has an attachment end 32 which may include a bolt hole 31 adapted for attachment to a wall anchor, such as wall anchor 20 or 25, by a corresponding bolt and nut 23/28. This mode of attachment of the anchor strap to the wall anchor is common, but it is contemplated that other attachment mechanisms may be provided that firmly connects the anchor strap 30 to the MSE wall 12.

The anchor strap 30 includes a plurality of punched openings 33 dispersed along the length of the planar strap. The openings 33 are formed so that the material from the opening forms a punched tab 34 projecting from the surface of the strap, as best seen in FIGS. 4 and 6. The tab 34 is thus integral with the remainder of the anchor strap 30. The openings 33 and tabs 34 enhance the fixation of each anchor strap or tension element within the backfill 16 that the anchor straps are buried in (as shown in FIG. 1). The backfill enters and engages within the punched openings 33. The tabs 34 act like a drag brake to resist translation of the anchor straps within the backfill.

The openings and tabs may be formed in a known sheet metal punching operation. The strip forming the anchor element 30 is thick enough to maintain structural integrity but thin enough to facilitate the punching operation. In one specific embodiment the strip is 0.125 in. thick galvanized steel. The punching force is also dictated by the size of the opening 33 being punched. In one embodiment the openings are square with each side about 1.0 in. The tabs 34 are thus generally square in shape and project slightly less than 1.0 in. beyond the surface of the strip. The tabs may project generally perpendicularly from the opposite surfaces of the anchor strip, or the punching operation may be modified so that the tabs project at a non-perpendicular angle. The openings and tabs may be spaced uniformly along the length of the anchor strip, with the length of the strip being adjusted to fit the particular job site. In one specific embodiment thee openings 33 are spaced about 12.0 in. apart.

The openings 33 may be square as indicated above. However, other shapes of the openings and tabs are contemplated, bearing in mind any ease or difficulty in punching the anchor strip to the desired shape. Nominally, either a square or a rectangle shape may be preferred for simplicity.

Figure 7:
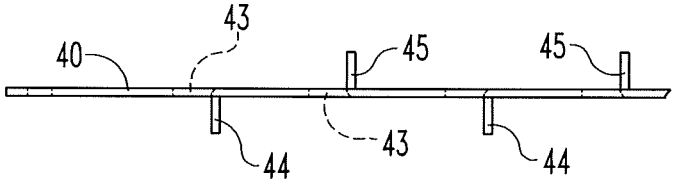
FIG. 7 is a side elevational view of another anchor element for use in an MSE system as shown in FIG. 1.

In the embodiment shown in FIG. 6, the tabs 34 all project downward. Alternatively, an anchor strap 40 may be utilized in which the tabs alternate between projecting upward and downward, as depicted in FIG. 7. Thus, the anchor strap 40 includes a plurality of punched openings 43 with some tabs 44 facing downward and other tabs 45 facing upward.

Figure 8:
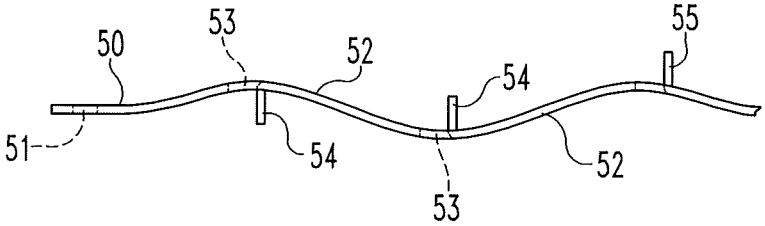
FIG. 8 is a side elevational view of yet another anchor element for use in an MSE system as shown in FIG. 1.

The stability of the anchor strap in tension may be enhanced by providing undulations, such as shown in FIG. 8. The anchor strap 50 in this embodiment includes a general planar attachment end 51 that merges into an undulating portion formed by a series of undulations 52. The punched openings 53 may situated at the apex of each undulation. The punched tabs may project outward from the concave side of an undulation, such as the tabs 54, or may project outward from the convex side of the undulation, such as the tab 55. The combination of the undulations and tabs provide significant resistance to translation of the MSE wall 12 when the anchor straps 50 are embedded within the backfill 16.

Figure 9:
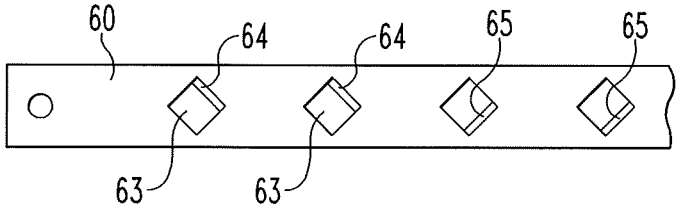
FIG. 9 is a top elevational view of a further anchor element in an MSE system as shown in FIG. 1.

In the embodiment shown in FIG. 9, the anchor strap 60 includes punched openings 63 that are skewed relative to the length of the strap. The punched tabs 64, 65 are thus also skewed at an angle relative to the longitudinal axis of the strap. The tabs may be configured so that the tabs 64 are at ninety degrees to the tabs 65, as shown in the figure. It is of course appreciated that the tabs may have the same orientation along the entire length of the strap 60, or may be provided in different orientation patterns.

The anchor straps 30, 40, 50 and 60 may be manufactured from roll strip stock of galvanized steel or other corrosion resistant material. The material must have sufficient tensile strength or stiffness to resist elongated under load. Moreover, the material must be sufficiently stiff so that the punched tabs 34, 44, 45, 54, 55, 64, 65 will hold their orientation relative to the strap under load. The openings and tabs may be formed in a standard punching operation, with appropriate modifications to permit variations in orientation of the punched tabs.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. An anchor element for a mechanically stabilized earth system having a wall supporting backfill, the anchor element comprising:

an elongated strap having an attachment end configured for attachment to the wall and having opposite surfaces along a length of the elongated strap, the elongated strap also having an undulation portion having a plurality of undulations spaced along the length; and a plurality of punched openings formed in the undulation portion along the length of said elongated strap, each opening of the plurality of openings including a punched tab projecting outwardly from one of said opposite surfaces, wherein the attachment end of the elongated strap generally defines a plane and said punched tabs project outwardly in directions substantially orthogonal to said plane, and wherein at least one punched tab projects from a concave side of an undulation of the plurality of undulations.

2. The anchor element of claim 1, wherein said punched openings are rectangular.

3. The anchor element of claim 2, wherein said punched openings are square.

4. The anchor element of claim 2, wherein said rectangular punched openings are aligned with a longitudinal axis of said elongated strap.

5. The anchor element of claim 2, wherein said rectangular punched openings are skewed relative to a longitudinal axis of said elongated strap.

6. The anchor element of claim 1, wherein at least one first punched tab projects outwardly from a first surface of said opposite surfaces, while at least one second punched tab projects outwardly from a second surface of said opposite surfaces.

7. The anchor element of claim 1, wherein at least one of said punched openings is defined at an apex of at least one undulation of said plurality of undulations.

8. The anchor element of claim 1, wherein said attachment end includes an opening for receiving a bolt for attachment to the wall.

9. The anchor element of claim 1, wherein said punched openings are sized to receive particulate backfill therein.

10. A mechanically stabilized earth system comprising:

a vertically oriented wall offset from an earthen feature;

backfill disposed between said wall and the earthen feature;

a plurality of anchor elements attached at one end to said wall and extending from said wall toward the earthen feature, said plurality of anchor elements embedded within said backfill and including;

an elongated strap having an attachment end configured for attachment to the wall and having opposite surfaces along a length of the elongated strap, the elongated strap also having an undulation portion having a plurality of undulations spaced along the length; and a plurality of punched openings formed in the undulation portion along the length of said elongated strap, each opening of the plurality of openings including a punched tab projecting outwardly from one of said opposite surfaces, wherein the attachment end of the elongated strap generally defines a plane and said punched tabs project outwardly in directions substantially orthogonal to said plane, and wherein at least one punched tab projects from a concave side of an undulation of the plurality of undulations.

11. The mechanically stabilized earth system of claim 10, wherein said punched openings are rectangular.

12. The mechanically stabilized earth system of claim 11, wherein said rectangular punched openings are aligned with a longitudinal axis of said elongated strap.

13. The mechanically stabilized earth system of claim 11, wherein said rectangular punched openings are skewed relative to a longitudinal axis of said elongated strap.

14. The mechanically stabilized earth system of claim 10, wherein at least one first punched tab projects outwardly from a first surface of said opposite surfaces, while said at least one second punched tab projects outwardly from a second surface of said opposite surfaces.

15. The mechanically stabilized earth system of claim 10, wherein at least one of said punched openings is defined at an apex of at least one undulation of said plurality of undulations.

16. The mechanically stabilized earth system of claim 10, wherein:

said wall includes a corresponding plurality of wall anchors disposed within said wall, each of said wall anchors including an attachment end defining an opening for receiving a bolt; and said attachment end of each of said anchor elements includes an opening for receiving said bolt for attachment of said anchor element to said wall anchor.

17. The mechanically stabilized earth system of claim 10, wherein said plurality of wall anchors are spaced vertically along said wall.

18. The mechanically stabilized earth system of claim 10, wherein:

said backfill is particulate backfill; and said punched openings are sized to receive said particulate backfill therein.

19. An anchor element for a mechanically stabilized earth system having a wall supporting backfill, the anchor element comprising:

an elongated strap having an attachment end configured for attachment to the wall and having opposite surfaces along a length, the elongated strap defining a longitudinal axis extending along the length; and a plurality of punched openings formed along the length of said elongated strap, each opening of the plurality of openings including opening sides and a punched tab extending from one of the opening sides and projecting outwardly from one of said opposite surfaces, wherein at least one opening of the plurality of openings is formed such the opening sides are neither parallel to or perpendicular to the longitudinal axis of the elongated strap and at least one other opening of the plurality of openings is formed such that the opening sides are neither parallel to or perpendicular to the longitudinal axis of the elongated strap, and wherein the punched tab of the at least one other opening is oriented at a different angle relative to the longitudinal axis of the elongated strap than the punched tab of the at least one opening.

* * * * *